US005852360A

United States Patent [19]

Levinson

[11] Patent Number: 5,852,360

[45] Date of Patent: Dec. 22, 1998

[54] PROGRAMMABLE LOW DRIFT REFERENCE VOLTAGE GENERATOR

[75] Inventor: Roger Levinson, Sunnyvale, Calif.

[73] Assignee: Exar Corporation, Fremont, Calif.

[21] Appl. No.: 844,166

[22] Filed: Apr. 18, 1997

[51] Int. Cl.[6] ..... G05F 3/16

[52] U.S. Cl. ..... 323/316; 323/314; 323/317; 327/396

[58] Field of Search ..... 323/313, 314, 323/316, 317; 327/407, 408, 396, 73

[56] References Cited

U.S. PATENT DOCUMENTS 5,122,680 6/1992 Stakely et al. ..... 327/73

5,281,906 1/1994 Thelen, Jr. ..... 323/313

5,650,739 7/1997 Hui et al. ..... 327/262

*Primary Examiner*—Shawn Riley

*Attorney, Agent, or Firm*—Townsend and Townsend and Crew LLP

[57] ABSTRACT

A reference voltage generating method and circuit is disclosed where the output can be programmably calibrated for minimum temperature drift. Output calibration is performed by adjusting a value of resistance of a resistor in a band-gap circuit. Digitally programmable switches are used to incrementally reduce or increase the value of the target resistor. The control circuit according to the present invention is also designed such that it tracks variations in process and temperature.

17 Claims, 2 Drawing Sheets

PROGRAMMABLE LOW DRIFT REFERENCE VOLTAGE GENERATOR

BACKGROUND OF THE INVENTION

The present invention relates in general to integrated circuits, and in particular to a reference voltage generator circuit that has a digitally programmable control interface for generating a low temperature drift reference voltage.

Reference voltage generators are commonly used in integrated circuits to, for example, set up biasing (or DC) conditions of the circuit, or to compare against input signal levels in data converters (analog-to-digital or digital-to-analog). It is often desirable to provide a reference voltage that is stable over variations in temperature. This is because variations in operating temperature often adversely affect the accuracy of electronic components for a given function. Most electronic components are designed to operate over a commercial range of 0 to 70 degrees centigrade. Military standard parts require additional stability, and are specified over the −55 to +125 degree centigrade range. Changes in the level of the reference voltage must therefore be minimized over this temperature range.

Reference voltage variation due to temperature drifts is a more critical problem in certain integrated circuits such as analog-to-digital converters (ADCs) or digital-to-analog converters (DACs). Component temperature can change due to variations in surrounding ambient air, or due to internal heating of the part itself. To build higher resolution or more accurate ADCs and DACS, reference generation circuitry requires increased stability accordingly. The band-gap reference circuit which provides a low temperature coefficient has been used with some success. In the basic band-gap reference design, reference voltage drift over temperature is minimized by summing two parameters with opposite temperature coefficients. A description of the basic band-gap reference technique is described in the text book "Analysis and Design of Analog Integrated Circuits," by Gray and Meyer. The classic band-gap reference technique takes advantage of the fact that the base-emitter junction voltage $V_{BE}$ of a bipolar transistor and the thermal voltage $V_T$ exhibit opposite temperature coefficients (Tc). The circuit is designed such that the positive Tc of $V_T$ cancels the negative Tc of $V_{BE}$ resulting in an output voltage that is nominally independent of temperature variations.

Although the basic band-gap reference yields a relatively stable reference voltage for many applications, its accuracy suffers during manufacturing. Device parameters such as the saturation current $I_S$ and junction voltage $V_{BE}$ vary over manufacturing processes. Also component values such as the final resistance of resistor elements used in the band-gap circuit also vary over manufacturing process. Given reasonable scrutiny during the manufacturing process, a band-gap circuit having less than a 150 ppm variation over the entire specified temperature range would be considered reasonable with today's technology. In many applications, however, a band-gap reference with this magnitude of Tc tolerances is not suitable.

To further improve the stability of the band-gap reference voltage, various optimization/calibration methods have been employed during the manufacturing process. A typical optimization method uses lasers to trim thin film resistors after wafer fabrication. This method, however, introduces new temperature variation problems by changing the temperature coefficient of the resistor. Other standard methods of trimming include zener zapping and fuse links. Both methods utilize an array of resistors. Active resistors are selected during the final manufacturing optimization process. In the case of zener zapping, a zener is permanently shorted to a selected resistor. With fuse linking, a link is vaporized to make a resistor active.

All of the above methods of calibration aim for optimized resistance value for the resistor elements in the band-gap circuit to yield the optimum reference output voltage for a given manufacturing process. Once calibrated according to these methods, however, the changes are permanent. After the circuit is calibrated once, the existing optimization/calibration techniques do not provide the capability to further calibrate the circuit.

SUMMARY OF THE INVENTION

The present invention provides method and circuitry for a reprogrammable control interface for a reference voltage such as a band-gap circuit. The control interface provides means for reprogrammably optimizing the performance of the reference circuit. Broadly, the invention provides a method of reprogrammably controlling the resistance of one or more of the band-gap resistors digitally.

Accordingly, in one embodiment, the present invention provides a reference voltage generating circuit including a resistor element having plurality of resistor segments, and a corresponding plurality of digitally reprogrammable switches respectively coupled in parallel to the plurality of resistor segments. The circuit further includes a control circuit coupled to the plurality of digitally reprogrammable switches. The control circuit includes a plurality of input terminals that allow the user to program the state of the plurality of switches. By selectively turning the switches on or off, the resistance value of the resistor element is fine tuned.

In another embodiment, the plurality of digitally programmable switches are implemented by pass transistors, and the control circuit further includes a bias voltage generator that generates a bias voltage coupled to a plurality of switch drivers. The switch drivers supply the bias voltage to the pass transistors such that the variation in the on-resistance of the pass transistors track the resistance variations of the plurality of resistor segments.

A better understanding of the nature and advantages of the low drift voltage reference circuit of the present invention may be had with reference to the detailed description and the drawings below.

DESCRIPTION OF THE PREFERRED EMBODIMENT

Figure 1:
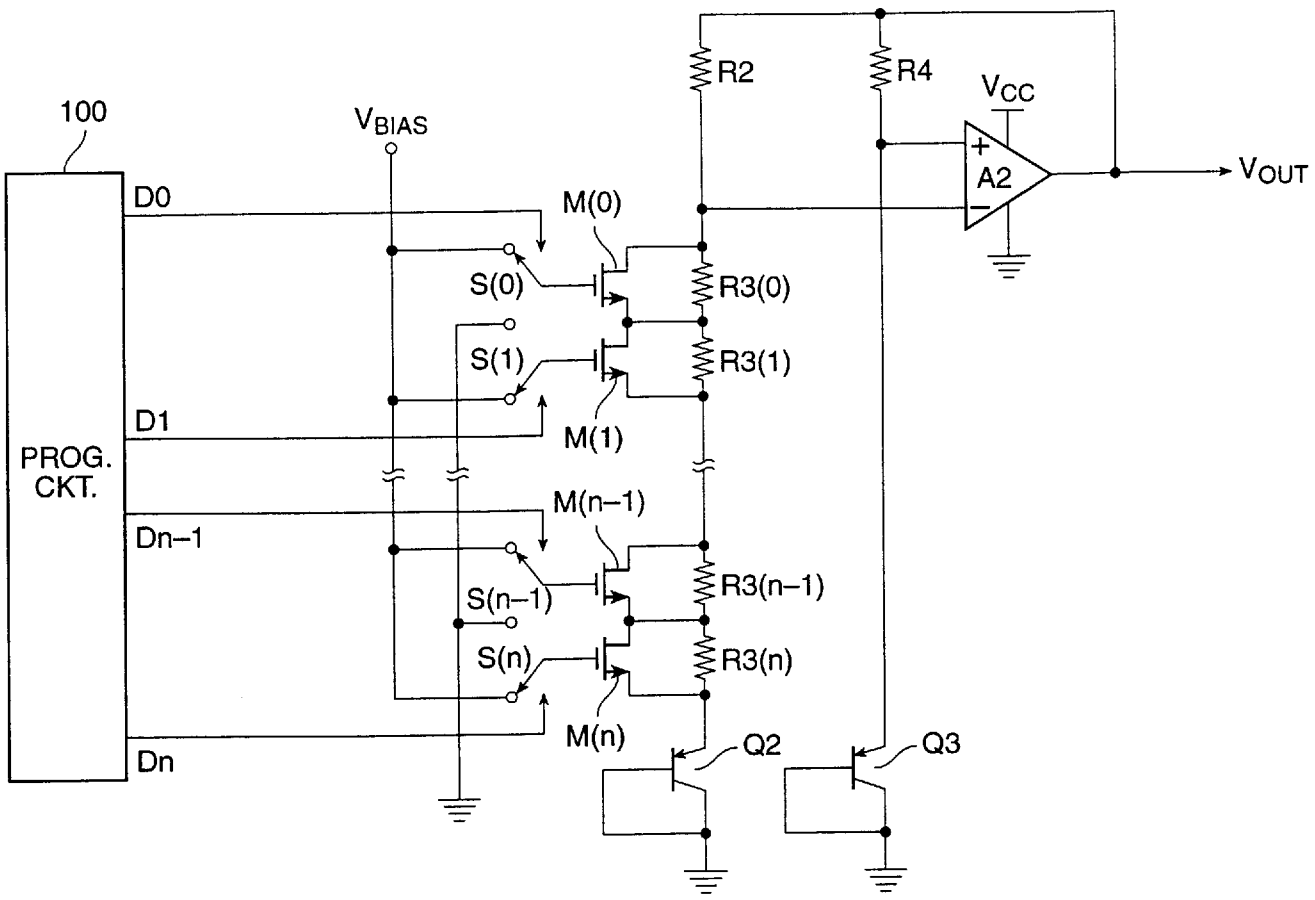
FIG. 1 shows a simplified example of a band-gap circuit with the digitally reprogrammable control circuit according to the present invention.

Referring to FIG. 1, there is shown a simplified embodiment of the programmable reference voltage generator circuit according to the present invention. The example shown in FIG. 1 is based on a band-gap reference circuit that includes resistors R2 and R4 connecting between the inputs of an operational amplifier (opamp) A2 and its output $V_{OUT}$. Diode-connected bipolar transistor Q3 connects to one input of opamp A2 directly and diode-connected bipolar transistor Q2 connects to the other input of opamp A2 via a serially connected chain of resistors R3(0) through R3(n). Field effect transistors M(0) through M(n) connect in parallel across resistors R3(0) through R3(n), respectively. The gate terminals of transistors M(0) to M(n) connect to switches S(0) to S(n), respectively. A programmable circuit 100 supplies control signals $D_0$ to $D_n$ to switches S(0) to S(n), respectively.

$$V_{out} = V_{BE} + \left( \frac{\Delta V_{BE}}{R_3} \right) \cdot R_2$$

where, $\Delta V_{BE}$ is a function of $V_T$ (where $V_T = K^T/_q$).

Thus, by adjusting the value of R3, $V_{OUT}$ can be fine tuned to the desired value. The resistive characteristic of each transistor M(i) shunts current around the band-gap resistive component R3. Switches S(0) to S(n) steer the input to each transistor either to ground, or to a bias voltage shown as $V_{BIAS}$. Steering the gate terminal of each transistor to ground turns the device off, effectively removing it from the circuit. When a transistor is turned off the resistance of the circuit is that of the band-gap resistor component R3(i) only. Alternatively, steering the gate terminal of a transistor M(i) to $V_{BIAS}$ turns on the device, providing a parallel resistance.

The amount of on-resistance for each transistor M(i) is dependent on the $V_{BIAS}$ voltage and the size of the transistor. The on-resistance of an FET is given by:

$$R_{on} = 1[(K)(W/L)(V_{GS} - V_{th})],$$

where, $R_{on}$=FET on-resistance, K is a process related constant, width W and length L are physical dimensions of the device, $V_{GS}$ is the gate to source voltage, and $V_{th}$ is the FET's threshold voltage. By setting $V_{BIAS}$ to a desired level, each transistor M(i) is biased to a desired operating point. The circuit of FIG. 1 allows the designer to design the circuit for a desired resolution by selecting the number of FETs M(i) and resistor tap points. Further, various FET sizes can be used to provide increased or decreased current shunting capability. In one embodiment, the present invention uses parallel connected FETs M(i) across each resistor component R3(i) that are programmably turned on or off to adjust the resistance value.

Programmable circuit 100 that generates digital control inputs $D_0$ to $D_n$ can be implemented in a number of different ways according to the present invention. To provide the user with the reprogrammability option, a user programmable read only memory (PROM) can be used as programmable circuit 100. In this case the user runs calibration on the device and then programs the PROM with corrected optimization data. The optimization control data may be supplied through, for example, a computer or other device. Alternatively, permanent or static control can be provided using zener zapping or fuse link control circuitry. According to this embodiment, the control and calibration would be performed once, preferably near the final stages of the manufacturing process.

Figure 2:
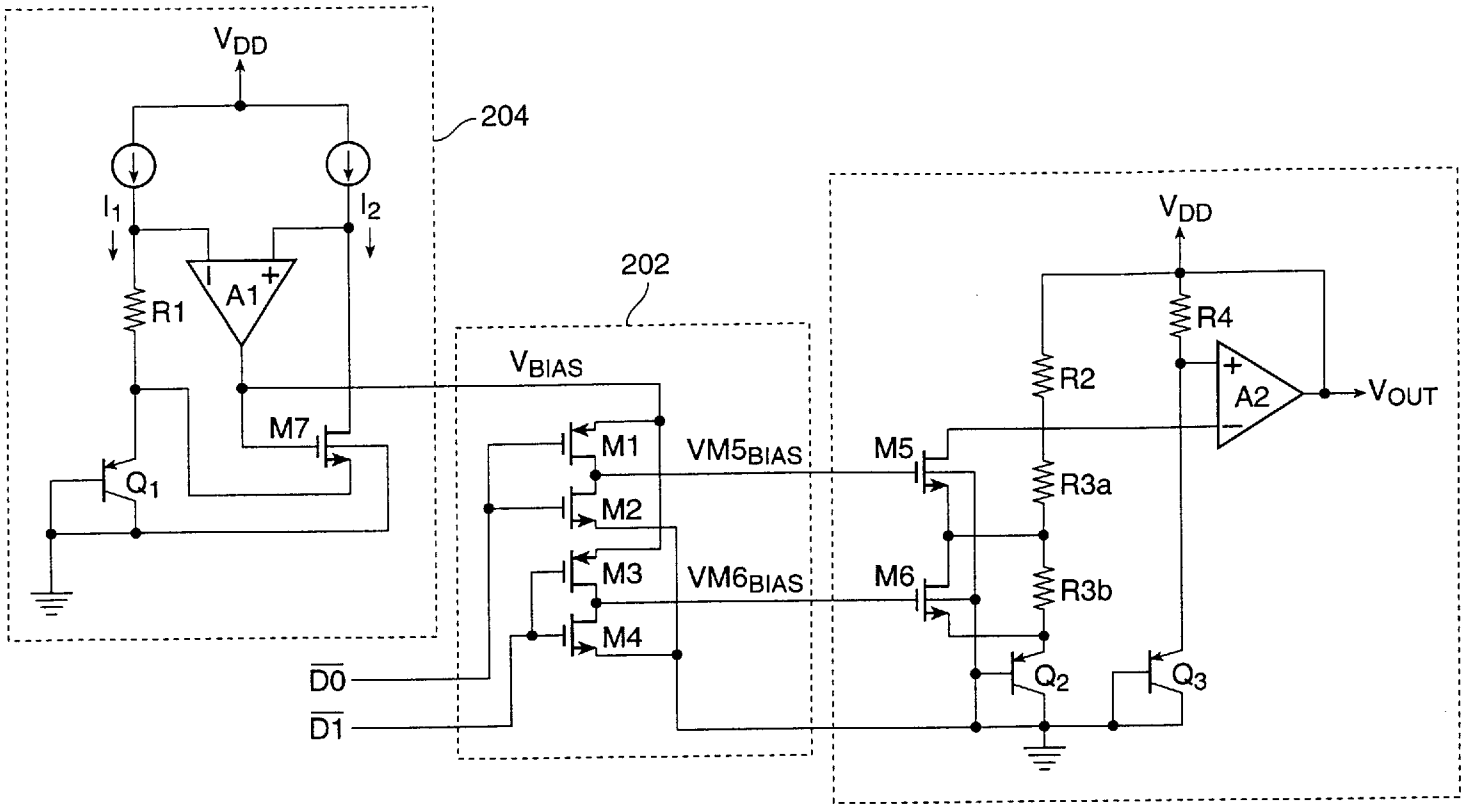
FIG. 2 shows a more detailed schematic of the reprogrammably calibrated band-gap circuit according to the present invention.

FIG. 2 shows a more detailed schematic of an exemplary embodiment of the programmable band-gap reference generator of the present invention. In this diagram the same reference numerals are used to refer to the same elements as in FIG. 1. In this example, only two control bits are used along with programmable resistive element R3 which includes two resistors R3*a* and R3*b* to simplify the description. It is to be understood that R3 can be divided into as many segments as desired with a corresponding number of control bits and switch FETs. Shunt FETs M5 and M6 provide the programmable adjustment for the band-gap reference. The programmable control operates similarly to that described above in connection with FIG. 2.

An exemplary method of providing the digital control interface is shown in block 202. This interface is made up of standard inverter components with FETs M1/M2 driving shunt transistor M5, and FETs M3/M4 driving shunt transistor M6. When control bit D0 is at a logic high level, PMOS transistor M1 turns off and NMOS transistor M2 turns on. This provides a voltage near ground potential to the gate terminal of shunt transistor M5 which turns the device off. The high impedance of M5 when turned off effectively removes its shunting effect and the value of the resistance would be that of R3*a* only. When control bit D0 is at a logic low level, basically the opposite happens to FETs M1 and M2. M1 turns on while M2 turns off. In this case, a positive voltage equal to $V_{BIAS}$ is applied to the gate terminal of transistor M5. As the potential at the gate terminal of M5 is now at a positive voltage, M5 turns on providing a shunt impedance across R3*a*. This causes the effective resistance value to drop. The size of M5 and $V_{BIAS}$ may be designed such that the on-resistance of M5 is, for example, equal to the resistance value of R3*a*. In that case, when M5 is turned on, the effective resistance value is reduced by one-half. The operation of the circuit in response to control bit D1 is similar to that of D0.

$V_{BIAS}$ can be generated using a number of different techniques. It is preferable, however, that the value of $V_{BIAS}$ track process and temperature variations. This is because the on-resistance of shunt FETs M5 and M6 can vary 30% to 40% over process, and thus $V_{BIAS}$ should preferably be designed such that M5 and M6 match R3*a* and R3*b* respectively over temperature and process. The exemplary circuit shown in block 204 provides a preferred embodiment of a $V_{BIAS}$ generator that accomplishes this task. According to the present invention, bias voltage generator 204 uses the same type of components as those found in the band-gap circuit. As these components are made of the same material and follow the same manufacturing process, their process variation will be nearly equal to the process variations seen for the band-gap components. Additionally, these components experience the same temperature variations as those used in the band-gap circuitry during actual operation.

Bias voltage generator 204 provides two arbitrary but constant currents I1 and I2 that flow through the simulated band-gap components, resistor R1 and FET M7. The circuit includes an operational amplifier A1, whose inputs sense the voltage levels at one terminal of resistor R1 and FET M7. The negative (−) input to opamp A1 senses a voltage drop across R1 that is proportional to manufacturing process variations and the current operating temperature of the device. The output of opamp A1 drives the gate terminal of FET M7. The internal feedback loop characteristics of opamp A1 forces the voltage drop across FET M7 to be equal to the voltage across R1. Assuming M7 is biased in the triode region, its on-resistance will track the resistance of R1 over process and temperature. This technique therefore also neutralizes the undesirable changes caused by manufacturing process and operating temperature variations of FET M7. The output voltage of A1 is therefore exactly correct for providing an FET on-resistance substantially equal to the resistance of the simulated band-gap resistor R1. The output of opamp A1 is also applied to the gate terminals of shunt FETs M5 and M6 of the band-gap circuit, when FETs M1 and M3 are turned on by digital control bits D0 and D1. Thus, shunt FETs M5 and M6 turn on with an on-resistance that tracks the resistance of R1. Therefore, shunt FETs M5 and M6 exhibit on-resistance characteristics which track R3*a* and R3*b* and will introduce no additional errors.

Bipolar transistor Q1 in bias voltage generator 104 is there to emulate the effect of Q2 and Q3 in the band-gap cell. Some FET designs require that the body of the device be connected to the most negative voltage $V_{EE}$ (or ground as shown). However, the potential at the source terminals of FETs M7 and M6 is one base-emitter voltage $V_{BE}$ above the ground level due to the series insertion of Q1 and Q2. Generally, due to FET body effect, operating the source and drain terminals of an FET at different voltages results in a change of FET threshold voltage. Adding Q1 to the reference circuitry insures that the reference circuit more accurately duplicates the operating conditions of the band-gap circuit.

In conclusion, the present invention provides a reference voltage generator whose output can be programmably calibrated for minimum temperature drift. Output calibration is performed by adjusting the value of a resistor in a band-gap circuit. Digitally programmable switches are used to incrementally reduce or increase the value of the target resistor. The control circuit according to the present invention is also designed such that it tracks variations in process and temperature. While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents.

What is claimed is:

1. A reference voltage generating circuit comprising:

a band-gap circuit having a first resistor, a second resistor and a third resistor coupled to inputs of an amplifier, said amplifier having an output generating a reference voltage, said first resistor being divided into a plurality of serially coupled resistor segments;

a corresponding plurality of programmable switches respectively coupled in parallel to said plurality of resistor segments; and a control circuit coupled to said plurality of programmable switches for controlling a state of said switches, wherein, by turning selected ones of said plurality of switches on or off, a resistance value of said first resistor element is adjusted thereby fine tuning a value of said reference voltage.

2. The reference voltage generating circuit of claim 1 wherein each one of said plurality of programmable switches comprises a pass transistor.

3. The reference voltage generating circuit of claim 2 wherein said pass transistor is a field effect transistor (FET) having a gate terminal as its control terminal, and first and second source/drain terminals coupled across an associated one of said plurality of resistor segments.

4. The reference voltage generating circuit of claim 3 wherein said control circuit comprises a plurality of switch drivers each having an output respectively coupled to a gate terminal of an associated pass transistor of said plurality of switches.

5. The reference voltage generating circuit of claim 4 wherein said control circuit further comprises a user programmable circuit coupled to said plurality of switch drivers.

6. The reference voltage generating circuit of claim 4 wherein each one of said switch drivers is an inverter circuit that couples said gate terminal of an associated pass transistor to one of a first and second reference signals.

7. The reference voltage generating circuit of claim 6 wherein said inverter circuit comprises a P-channel field effect transistor (FET) coupling said gate terminal to said first reference signal, and an N-channel FET coupling said gate terminal to said second reference signal.

8. The reference voltage generating circuit of claim 3 wherein said control circuit drives said gate terminal to a bias voltage to turn on said FET, and drives said gate terminal to a reference signal to turn off said FET.

9. The reference voltage generating circuit of claim 8 wherein a level of on-resistance of each of said pass transistors is adjusted by controlling a level of said bias voltage.

10. The reference voltage generating circuit of claim 9 wherein said control circuit further comprises:

a control circuit resistor substantially replicating one of said plurality of serially coupled resistor segments;

a control circuit field effect transistor substantially replicating said FET of said programmable switch; and a control circuit operational amplifier having first and second inputs coupled to said control circuit resistor and control circuit FET, respectively, and an output coupled to a gate terminal of said control circuit FET, wherein, said output of said control circuit operational amplifier generates said bias voltage.

11. A band-gap reference voltage generating circuit comprising:

a band-gap reference circuit having a first band-gap resistor divided into a plurality of serially coupled resistor segments;

a plurality of field effect transistors (FETs) each having first and second source/drain terminals respectively coupled across one of said plurality of serially coupled resistor segments; and a digitally programmable control circuit having output terminals coupled to gate terminals of said plurality of FETs, wherein, said output terminals of said digitally programmable control circuit adjust a value of resistance of said first band-gap resistor by controlling a state of said plurality of FETs.

12. The band-gap reference voltage generating circuit of claim 11 wherein said digitally programmable control circuit comprises:

a driver circuit having outputs coupled to gate terminals of said plurality of FETs;

a user programmable circuit having outputs coupled to inputs of said driver circuit; and a bias voltage generating circuit having an output coupled to said driver circuit, wherein, said bias voltage generating circuit controls an on-resistance of said FETs to track a resistance value of said plurality of serially coupled resistor segments over temperature.

13. The band-gap reference voltage generating circuit of claim 12 wherein said bias voltage generating circuit comprises:

an operational amplifier having first and second input terminals and an output terminal;

first and second current source devices respectively coupled to said first and second input terminals of said operational amplifier;

a resistor substantially replicating one of said plurality of serially coupled resistor segments, said resistor being coupled to said first input of said operation amplifier; and a FET substantially replicating one of said plurality of FETs, said FET having a first source/drain terminal coupled to said second input of said operational amplifier and a gate terminal coupled to said output of said operational amplifier, wherein, said output of said operational amplifier generates said bias voltage.

14. A method for generating a band-gap reference voltage comprising the steps of:

dividing a resistor in the band-gap circuit into a plurality of serially coupled segments of resistors;

coupling in parallel to each of said plurality of serially coupled segments of resistors, a field effect transistor; and adjusting a resistance value of said resistor by controlling a state of said field effect transistor.

15. The method of claim 14 wherein said step of adjusting a resistance value of said resistor by controlling a state of said field effect transistor further comprises the steps of:

supplying a first reference signal to a gate terminal of said field effect transistor to turn on said field effect transistor with a selected on-resistance; and supplying a second reference signal to said gate terminal of said field effect transistor to turn off said field effect transistor.

16. The method of claim 15 wherein said steps of supplying a first and second reference signals comprises a step of digitally programming a programmable circuit to supply control data.

17. The method of claim 16 wherein said step of supplying a first reference signal comprises a step of generating a bias voltage that ensures said on-resistance of said field effect transistor tracks variations in resistance value of one of said serially coupled plurality of resistor segments over temperature.

* * * * *